US008092213B2

(12) United States Patent
Leinemann

(10) Patent No.: US 8,092,213 B2
(45) Date of Patent: Jan. 10, 2012

(54) FLAME ARRESTER INSERT AND PROCESS FOR ITS PRODUCTION

(75) Inventor: Christoph Leinemann, Braunschweig (DE)

(73) Assignee: Leinemann GmbH & Co. KG, Braunschweig (DE)

( * ) Notice: Subject to any disclaimer, the term of this patent is extended or adjusted under 35 U.S.C. 154(b) by 0 days.

(21) Appl. No.: 11/755,185

(22) Filed: May 30, 2007

(65) Prior Publication Data

US 2007/0279825 A1 Dec. 6, 2007

(30) Foreign Application Priority Data

Jun. 6, 2006 (DE) ..... 10 2006 026 510

(51) Int. Cl.
*F23D 14/82* (2006.01)
*C23C 18/12* (2006.01)

(52) U.S. Cl. ..... 431/346; 431/350; 431/9; 431/187; 431/10; 431/8; 60/39.11; 126/85 R

(58) Field of Classification Search ..... 431/346, 431/328, 7, 350, 9, 187, 10; 60/39.11; 126/85 R
See application file for complete search history.

(56) References Cited

U.S. PATENT DOCUMENTS

| | | | | | |
|---|---|---|---|---|---|
| 1,896,286 | A | * | 2/1933 | Burns et al. | 431/328 |
| 2,333,567 | A | * | 11/1943 | Helmore | 205/114 |
| 3,173,411 | A | | 3/1965 | Floyd | |
| 4,723,597 | A | * | 2/1988 | Sonoda | 165/133 |
| 4,869,230 | A | * | 9/1989 | Fletcher et al. | 126/91 A |
| 5,415,233 | A | * | 5/1995 | Roussakis et al. | 169/48 |
| 5,588,822 | A | * | 12/1996 | Hayakawa et al. | 431/1 |
| 5,942,339 | A | * | 8/1999 | Garcia | 428/680 |
| 6,199,749 | B1 | * | 3/2001 | Wieres et al. | 228/181 |
| 6,932,065 | B2 | * | 8/2005 | Naruse et al. | 123/644 |
| 6,978,845 | B2 | * | 12/2005 | Leinemann | 169/48 |
| 6,982,065 | B2 | * | 1/2006 | Carroni et al. | 422/177 |
| 2006/0008755 | A1 | | 1/2006 | Leinemann et al. | 431/346 |

FOREIGN PATENT DOCUMENTS

| | | | | |
|---|---|---|---|---|
| DE | 693 05 351 | T3 | | 6/1993 |
| DE | 103 36 530 | B3 | | 2/2005 |
| DE | WO2005014112 | | * | 2/2005 |
| EP | 0 649 327 | B1 | | 6/1993 |
| JP | 357115690 | A | * | 1/1981 |
| JP | 363057780 | A | * | 3/1988 |
| JP | 8337868 | A | * | 12/1996 |

OTHER PUBLICATIONS

European Search Report, issued on Jul. 17, 2007, pp. 1-2.

* cited by examiner

*Primary Examiner* — Steven B McAllister
*Assistant Examiner* — Nikhil Mashruwala
(74) *Attorney, Agent, or Firm* — Whitham Curtis Christofferson & Cook, PC

(57) ABSTRACT

In a flame arrester insert comprising two metal strips (1, 2) wound together, of which a first metal strip (1) is a smooth strip and the second metal strip (2) is a grooved strip having defined grooving, so that they rest on each other at defined contact points (3) and, between the contact points (3), form defined gaps (4) for the passage of a fluid, the stability can be increased and corrosion prevention can be implemented even with inexpensive materials by the metal strips (1, 2) resting directly on each other at the contact points (3) and, outside the contact points (3), having a surface coating (5) which, close to the contact points, is a uniform joint coating of the surfaces of the metal strips (1, 2) that point toward each other.

3 Claims, 1 Drawing Sheet

FLAME ARRESTER INSERT AND PROCESS FOR ITS PRODUCTION

The invention relates to a process for the production of a flame arrester insert from two metal strips wound together, of which a first metal strip is a smooth strip and the second metal strip is a grooved strip having defined grooving, which, after being wound, rest on each other at contact points and, between the contact points, form defined gaps for the passage of a fluid.

The invention further relates to a flame arrester insert comprising two metal strips wound together, of which a first metal strip is a smooth strip and the second metal strip is a grooved strip having defined grooving, so that they rest on each other at defined contact points and, between the contact points, form defined gaps for the passage of a fluid.

Flame arrester inserts of this type are disclosed, for example, by DE 103 36 530 B3. As a rule, the two metal strips are wound together spirally around a central core.

In this case, the production must be carried out extraordinarily carefully in order that the fluid passage gaps do not exceed a defined gap size, especially for highly explosive gases, since otherwise the safe extinguishing of a flame would not be ensured.

The metal strips used for the creation of the flame arrester insert must consist of highly heat resistant stainless steel, not only to have the necessary temperature resistance but also to be capable of resisting aggressive media, i.e. not corroding. Corrosion phenomena would alter the defined fluid passage gaps and thus possibly constitute a safety hazard.

The mechanical strength of flame arresters depends primarily on the friction of the metal strips at the contact points.

The corrosion-resistant materials used are normally distinguished by a very smooth, that is to say polished, surface, so that the stability of a flame arrester of the type in question here, in particular in the case of larger diameters, can represent a problem because of the relatively low friction. It may be necessary for special devices to be procured in order to be able to install the wound flame arrester inserts in a housing in which the inserts are held stably. Attempts have already been made to increase the stability of the flame arrester inserts by means of reinforcements soldered on axially. As a result, however, not only does the expenditure become higher but also the handling becomes more cumbersome, both during production and during the maintenance of the flame arresters.

The present invention is therefore based on the object of constructing a flame arrester insert in such a way that it can both be handled simply and stably and can also be formed with a high corrosion resistance.

According to the invention, this object is achieved by a process of the type mentioned at the beginning in that after the spiral winding, the two metal strips are provided with a surface coating in such a way that the contact points between the strips are fixed by the coating.

In an unconventional way, the process according to the invention provides for the flame arrester insert to be wound and then for a surface coating to be provided on the metal strips in the wound state. The consequence of this is that the strips are provided with a surface coating in the interspaces formed by the grooving, which form the fluid passage gaps, but at the contact points do not lie on one another with a coated surface but with the original material of the metal strips. In the immediate vicinity of the contact points, the metal strips resting on each other have a common surface coating, which fixes the metal strips in relation to each other in the region of the contact point. Since the wound flame arrester insert is provided with an enormous number of such contact points, the common surface coating in the region of the contact points achieves stable fixing of the metal strips resting on each other and, as a result, imparts high stability to the flame arrester insert.

The surface coating is preferably applied wet from a coating solution, specifically preferably without electric power, that is to say on the basis of a chemical reaction. In this case, the coating is preferably by means of a coating solution which contains nickel ions, which are reduced in the chemical reaction to form nickel metal. If phosphorus is additionally contained in the coating solution, the phosphorus content of the deposited layer can be controlled in a secondary reaction. Thus, a suitable coating is in particular that marketed by AHC Oberflächentechnik GmbH, Kerpen, Federal Republic of Germany, under the designation DURNI-COAT®. The coating solution contains nickel ions and hypophosphite ions. In the course of the reaction, the nickel ions are reduced to form nickel metal, and the hypophosphite ions are oxidized to form orthophosphite. The coating can be applied with a uniform thickness following the contours, even in the case of complicated structures, so that even edges and depressions and cavities can be coated uniformly. This coating is therefore suitable for defined maintenance of the gap widths of the flame arrester insert, so that the gaps have a defined, sufficiently large passage cross section, which limits the flow rate.

The above-mentioned object is also achieved with a flame arrester insert of the type mentioned at the beginning in that the metal strips rest directly on each other at the contact points and, outside the contact points, have a surface coating which, close to the contact points, is a uniform joint coating of the surfaces of the metal strips that point toward each other.

On account of the high stability achieved by the surface coating according to the invention and on account of the surface coating, which itself has high corrosion resistance, the metal strips used in the production of the flame arrester insert can be created from a more inexpensive material, so that it is possible to compensate, at least partly, for the costs for the surface coating by the use of a more inexpensive metal for the metal strips.

In the flame arrester insert according to the invention, the metal strips are preferably wound spirally.

The implementation of the present invention does not rule out the production of flame arrester inserts which have no grooved strip over certain annular sections, so that the flame arrester insert is formed only by smooth metal strip in these regions, in order in this way to implement annular regions from which heat is dissipated with a high thermal conductivity as a result of leaving out the gaps.

The invention will be explained in more detail by using the appended drawing, in which:

FIG. 1 shows a schematic section through an arrangement according to the invention of a grooved strip between two smooth strips;

Figure 2:
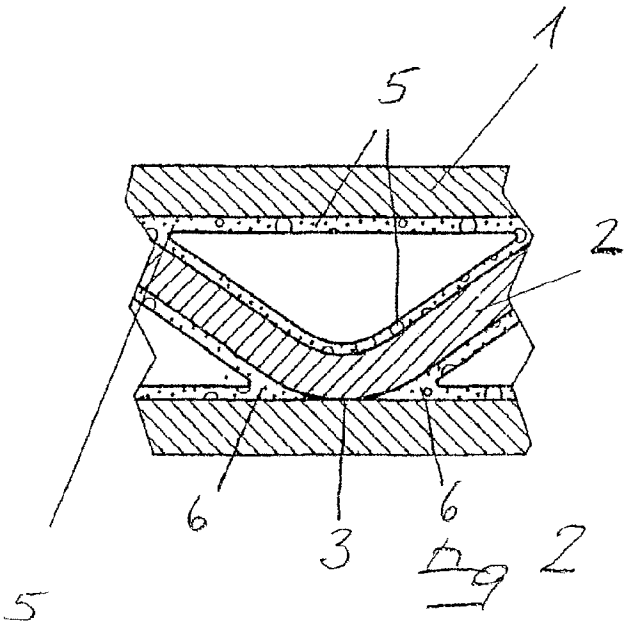
FIG. 2 shows an enlarged illustration of the detail X from FIG. 1.
Figure 4:
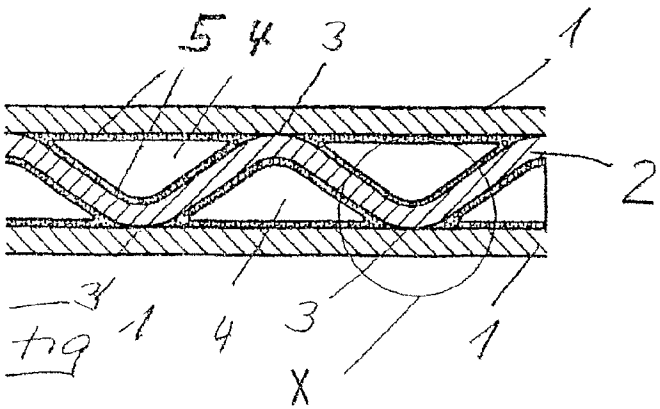

A flame arrester insert according to the invention is normally wound spirally by means of the joint winding of a first metal strip 1, formed as a smooth strip, with a grooved strip grooved in corrugated form and forming a second metal strip 2. Since the second metal strip is again adjoined by a first metal strip of the next spiral layer, the result is the sandwich situation illustrated in section in FIG. 1, in which the second strip 2 is located as a grooved strip between two turns of the first metal strip 1.

The second metal strip 2 rests with the peaks and valleys of its corrugations on the upper and lower first metal strip 1 at contact points 3.

Between the corrugation of the second metal strip 2 and the two contact points 3 which bound this corrugated region on the same side of the first metal strip 1, a defined cross section of a passage gap 4 is formed. In this way, on the flame arrester insert, a large number of fluid passage gaps 4 is implemented over the cross section of the flame arrester insert.

In this state, the flame arrester insert is provided with a surface coating 5.

As illustrated in particular by the enlarged illustration of FIG. 2, the surface coating 5 is built up on all the freely accessible surfaces of the two metal strips 1, 2 but not at the contact points 3, since there the metal strips 1, 2 rest directly on each other. In regions 6 which are immediately adjacent to the contact points 3, wedge-like interspaces are formed between the two metal strips 1, 2, which interspaces are filled by the surface coating 5, so that in these regions 6 the metal strips 1, 2 have a common surface coating 5. This common surface coating has the effect that the two metal strips 1, 2 adhere to each other in the regions 6 which are immediately adjacent to the contact points 3.

By means of this common coating, the two strips 1, 2 are fixed to each other in the region of the contact points 3. Since a flame arrester insert has an enormous number of contact points 3, in this way very high stability of the relative position of the metal strips 1, 2 in relation to each other is achieved, so that there is no risk that, on account of good and low-friction surfaces of the metal strips 1, 2, the wound flame arrester insert, in particular if it has a larger diameter, falls apart because the metal strips 1, 2 move relative to each other and lose the grip of the spiral winding in relation to each other on account of their weight.

The flame arrester insert according to the invention can thus be produced extraordinarily stably, even with large diameters. The use of a corrosion-resistant surface coating 5 leads to it being possible for a more inexpensive material to be used for the metal strips 1, 2.

The invention claimed is:

1. A process for the production of a flame arrester insert, comprising the steps of:

winding two stainless steel strips wound together, wherein a first stainless steel strip of said two stainless steel strips is a smooth strip and a second stainless steel strip of said two stainless steel strips is a grooved strip having defined grooving, which, after winding, rest on each other at contact points and, between the contact points form defined gaps for the passage of a fluid; and providing a surface coating on said two stainless steel strips after said winding step in such a way that the two stainless steel metal strips are coated on freely accessible surfaces, but not the contact points where the two stainless steel strips rest directly on each other, wherein the surface coating fixes the two stainless steel strips together in a configuration of a flame arrester insert with contact at the contact points and without any surface coating at the contact points, and wherein the surface coating is applied wet from a coating solution without electric power, wherein said coating solution includes nickel ions and phosphorous, and said providing step includes the reduction of said nickel ions to form nickel metal.

2. The process as claimed in claim 1, wherein the metal strips are wound together spirally in said winding step.

3. A flame arrester insert comprising:

two stainless steel strips wound together in a configuration of a flame arrester insert, of which a first metal strip is a smooth strip and the second metal strip is a grooved strip having defined grooving, so that they rest on each other at defined contact points and, between the contact points form defined gaps for the passage of a fluid, wherein the two stainless steel strips rest directly on each other at the contact points; and a surface coating on said two stainless steel strips outside the contact points but not at the contact points which fixes the two metal strips together with contact at the contact points, wherein the surface coating consists of metallic nickel additionally containing phosphorous.

* * * * *